United States Patent [19]

Yamada

[11] Patent Number: 4,854,582

[45] Date of Patent: Aug. 8, 1989

[54] HEAD CONNECTING DEVICE IN GOLF CLUBS

[76] Inventor: Kunio Yamada, 5-14, 4 chome, Hibarigao Kita Houya shi, Tokyo, Japan

[21] Appl. No.: 79,474

[22] Filed: Jul. 29, 1987

[51] Int. Cl.[4] ..... A63B 53/02

[52] U.S. Cl. ..... 273/80.2; 273/79; 273/80.1

[58] Field of Search ..... 273/77 A, 79, 80.1, 273/80.2, 80.3, 80.4, 80.5, 80.6, 80.7, 80.8, 80.9

[56] References Cited

U.S. PATENT DOCUMENTS

| | | | |
|---|---|---|---|
| 1,540,559 | 6/1925 | Murphy | 273/80.3 |
| 1,644,510 | 10/1927 | Buhrke | 273/80.3 |
| 1,994,149 | 3/1935 | Root | 273/80.2 |
| 2,027,452 | 1/1936 | Rusing | 273/79 |
| 2,067,556 | 1/1937 | Wettlaufer | 273/79 |
| 2,219,670 | 10/1940 | Wettlaufer | 273/79 |
| 2,425,808 | 8/1947 | Jakosky | 273/79 |

FOREIGN PATENT DOCUMENTS

| | | | |
|---|---|---|---|
| 751323 | 6/1956 | United Kingdom | 273/79 |

*Primary Examiner*—Leonard E. Smith
*Attorney, Agent, or Firm*—Donald D. Mon

[57] ABSTRACT

This invention relates to a head connecting device for golf clubs; particularly a cast iron head of a wooden golf club such as a driver, a baffy or a cleek, a creek. The object of this invention is to apply a setting part, is inclined which inclines against the axis of the pipe between the head and the shaft allowing a face angle $\alpha$ of the hitting face of the head to be adjusted easily by changing the direction or the angle of the setting parts.

6 Claims, 2 Drawing Sheets

HEAD CONNECTING DEVICE IN GOLF CLUBS

FIELD OF THE INVENTION

This invention relates to a head connecting device for golf clubs particularly a cast iron head of wooden golf club such as a driver, a brush, a baffy or a cleek, a creek.

BACKGROUND OF THE INVENTION

Recently, cast iron heads for golf clubs called "woods" in which a shaft is attached to a connecting part of the head are becoming more widely used due to a lack of wood resources. However scraping the iron face (i.e. hitting face of the head) is required to adjust the face angle of the head.

BRIEF DESCRIPTION OF THE INVENTION

The object of this invention is to eliminate this drawback by applying a setting part, ie a pipe having an eccentric bore, which is inclined against the axis of a pipe and a face angle $\alpha$ of the hitting face 1*a* of head 1 which can be adjusted easily by changing the angle of the setting parts.

The object of present invention is to provides a head connecting device for golf clubs in which a sleeve part for connecting a shaft is provided at the end of the head, setting parts of sleeve shape are mounted on the sleeve part of the head, and a circular bore for insertinga shaft is provided on the setting parts in an inclined direction against the axis of the setting parts.

The above and other features of this invention will be fully understood from the following and detailed description and accompanied drawings in which.

BRIEF DESCRIPTION OF THE DRAWINGS

FIG. 1(*b*) is a side view of the embodiment of FIG. 1.

DETAILED DESCRIPTION OF THE INVENTION

Figure 1A:
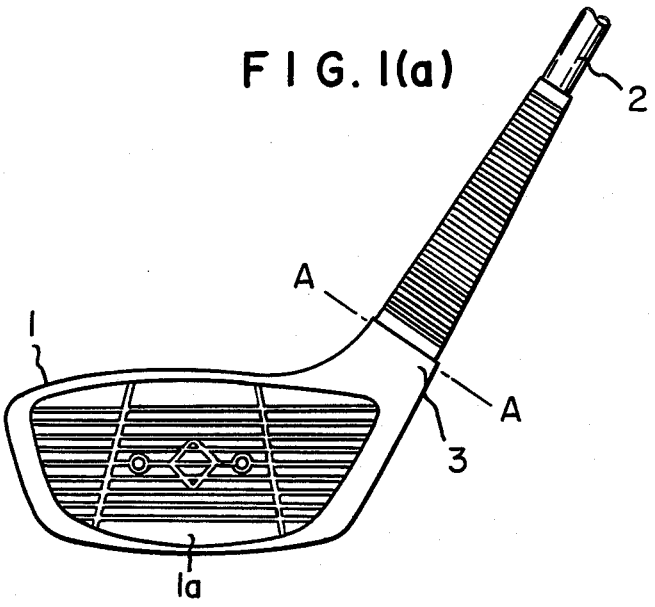
FIG. 1(*a*) is a front view of an embodiment of this invention.
Figure 1B:
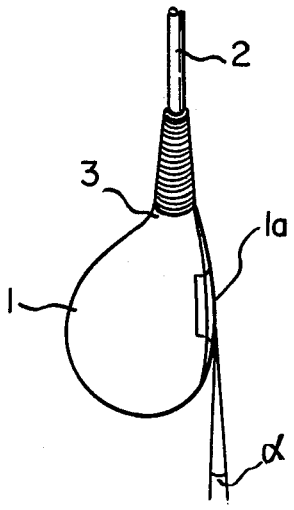
Figure 2:
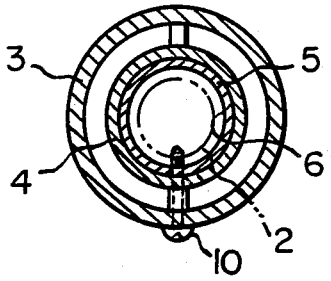
FIG. 2 is a cross sectional view along A—A of FIG. 1(*a*).
Figure 3A:
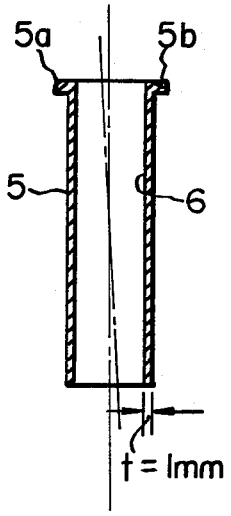
FIGS. 3(*a*) (*b*) and (*c*) are longitudinal cross sectional view of the setting sleeves.
Figure 3B:
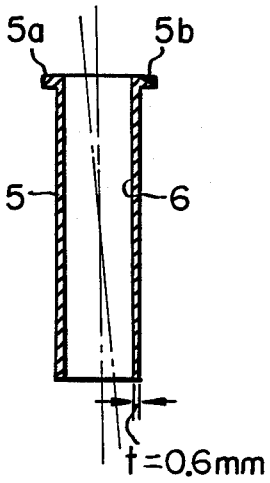
Figure 3C:
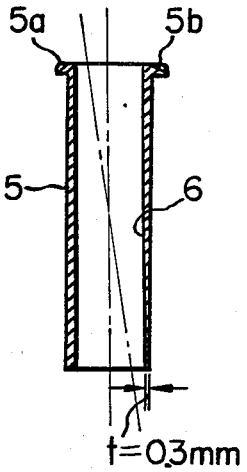

Reffering to FIGS. 1-3, in an embodiment of the present invention, the head connecting device for gold clubs comprises sleeve part 3 for connecting shaft 2 provided at the end of head 1. Setting part 5 of sleeve shape is mounted on sleeve part 3 of head 1. A circular bore 6 for inserting shaft 2 is provided on setting part 5 in in a direction inclined against the axis of setting part 5. Setting part 5 and shaft 2 are fixed to head 1 by screw 10 inserted from outside of head 1. An adhesive may be employed instead of screw 10.

Setting part 5 has flange 5*a* at the upper end and flange 5*a* has recess 5*b* allowing rotation. The outer diameter of the setting part 5 is 11 mm, the inner diameter of bore 6 is 8 mm, and the depth of bore 6 is 30 mm. As shown in FIGS. 3(*a*)(*b*)(*c*), three kinds of setting parts 5 are provided. The thicknesses t of setting parts 5 at the lower end are 1 mm, 0.6 mm, 0.3 mm respectively. Shaft 2 is inserted by 35 mm.

For connecting shaft 2to head 1, setting part 5 is inserted into inner sleeve portion 4 of sleeve part 3 on head 1. The direction of setting part 5 is then changed by rotation to change the direction of bore 6 and shaft 2 so that direction of the head 1 against the shaft 2 varies. Therefore the face angle $\alpha$ (loft); FIG. 1(*b*), can be adjusted without scraping the face.

I claim:

1. A device for connecting a cast iron golf club head to a golf club shaft comprising; a cylindrical sleeve on one end of said cast iron golf club head; a tubular sleeve shaped setting part being mounted on said said sleeve part of said golf club head; said tubular sleeve shaped setting part having a lengthwise bore at an incline to the overall axis of said tubular sleeve shaped setting part for receiving the end of said golf club shaft; means for rotating said tubular sleeve shaped setting part; whereby the angle of a face on said cast iron golf club head is varied with respect to the said shaft.

2. The device according to claim 1 in which said means for rotating said tubular sleeve shaped setting part comprises a peripheral flange on one end of said tubular sleeve shaped setting part; and a recess in said flange for assisting in rotating said tubular sleeve shaped setting part to vary the angle of said golf club shaft with respect to said golf club face.

3. The device according to claim 1 in which several tubular sleeves having bores with different angles of inclination are provided whereby the tubular sleeve shaped setting part having an amount of inclination desired may be selected.

4. The device according to claim 1 including means for securing said tubular sleeve against rotation after the desired angle has been adjusted.

5. The device according to claim 4 in which said securing means is a screw.

6. The device according to claim 4 in which said securing means is an adhesive.

* * * * *